US008500443B2

(12) United States Patent
Katagiri et al.

(10) Patent No.: US 8,500,443 B2
(45) Date of Patent: Aug. 6, 2013

(54) METHOD AND DEVICE FOR PURGING GAS PRODUCTION FURNACE

(75) Inventors: Tomoyuki Katagiri, Tokyo (JP); Hisanori Nukumi, Tokyo (JP); Kenichiro Kondo, Tokyo (JP)

(73) Assignee: IHI Corporation, Tokyo (JP)

( * ) Notice: Subject to any disclaimer, the term of this patent is extended or adjusted under 35 U.S.C. 154(b) by 486 days.

(21) Appl. No.: 12/934,546

(22) PCT Filed: Mar. 11, 2009

(86) PCT No.: PCT/JP2009/001080

§ 371 (c)(1),
(2), (4) Date: Sep. 24, 2010

(87) PCT Pub. No.: WO2009/119020

PCT Pub. Date: Oct. 1, 2009

(65) Prior Publication Data

US 2011/0020145 A1 Jan. 27, 2011

(30) Foreign Application Priority Data

Mar. 25, 2008 (JP) ..... 2008-076990

(51) Int. Cl.
*F27B 15/10* (2006.01)

(52) U.S. Cl.
USPC ..... 432/58; 432/14

(58) Field of Classification Search
USPC ..... 432/14, 15, 27, 58; 110/245; 48/197 R
See application file for complete search history.

(56) References Cited

U.S. PATENT DOCUMENTS

| | | | | | |
|---|---|---|---|---|---|
| 4,057,402 | A | * | 11/1977 | Patel et al. | 48/197 R |
| 4,969,930 | A | * | 11/1990 | Arpalahti | 48/197 R |
| 5,082,634 | A | * | 1/1992 | Raufast | 422/143 |
| 2008/0201980 | A1 | * | 8/2008 | Bullinger et al. | 34/493 |
| 2011/0016789 | A1 | * | 1/2011 | Nukumi et al. | 48/210 |

FOREIGN PATENT DOCUMENTS

| | | |
|---|---|---|
| JP | 60-17626 A | 1/1985 |
| JP | 6 184561 | 7/1994 |
| JP | 7 11261 | 1/1995 |
| JP | 9 111253 | 4/1997 |
| JP | 2003 56843 | 2/2003 |
| JP | 2005-41959 A | 2/2005 |
| JP | 3881712 B2 | 2/2007 |

* cited by examiner

*Primary Examiner* — Gregory A Wilson
(74) *Attorney, Agent, or Firm* — Oblon, Spivak, McClelland, Maier & Neustadt, L.L.P.

(57) ABSTRACT

A fluidized bed gasification furnace has a fluidized bed formed and a freeboard section F above a bed material so as to produce a produced gas by a reaction of raw material with a gasifying agent and take out the produced gas through the freeboard section. Upon shutdown of the furnace, inert gas is fed from below to the furnace for purging of gas in the fluidized bed with inert gas while steam is supplied to a freeboard section above the fluidized bed to purge a gas in the freeboard section with steam.

8 Claims, 2 Drawing Sheets

METHOD AND DEVICE FOR PURGING GAS PRODUCTION FURNACE

TECHNICAL FIELD

The present invention relates to a method and a device for purging a gas production furnace capable of safely and inexpensively purging the gas production furnace within a short time, the gas production furnace comprising a fluidized bed formed and a freeboard section above a bed material so as to produce a produced gas by a reaction of raw material with a gasifying agent and take out the produced gas through the freeboard section.

BACKGROUND ART

FIG. 1 shows an example of a circulating fluidized bed furnace 3 comprising a combustion furnace 1 and a fluidized bed gasification furnace 2 for production of a produced gas. Prior art literature for such circulating fluidized bed furnace is, for example, Patent Literature 1.

In the combustion furnace 1 constituting the circulating fluidized bed furnace 3 of FIG. 1, air or oxygen 4 is supplied from below, and at least either startup fuel 5 or char referred to hereinafter is supplied to a lower side portion of the furnace to bring about fluidized combustion and thus heating of circulating particles. Combustion fluid 6 from the combustion furnace 1 is guided to a separator 9 where it is separated into exhaust gas 7 and circulating particles 8.

Guided into the fluidized bed gasification furnace 2 (gas production furnace) constituting the circulating fluidized bed furnace 3 and filled with the bed material such as sand on a diffuser 11 are the separated hot circulating particles 8 from the separator 9 as well as a raw material 10 such as coal or biomass from above. A portion of the furnace below the diffuser 11 is supplied with steam S as gasifying agent from an auxiliary steam device 12 such as an auxiliary boiler or other facility to thereby form a fluidized bed 13 (bed) for gasification (steam gasification) of the raw material 10, and a produced gas 14 which is a mixture of gas components such as hydrogen ($H_2$), carbon monoxide (CO) and methane ($CH_4$) produced at a freeboard section F above the fluidized bed (bed) is lead out through a top of the furnace. A mixture 17 of the circulating particles 8 with unreacted char in the gasification furnace 2 is returned through a lead-in pipe 18 to the combustion furnace 1 where the char is burned to heat the circulating particles 8. The gasification furnace 2 is provided with a mechanism for blocking of gas movement between the furnaces 1 and 2.

The produced gas 14 produced in the gasification furnace 2 is taken out through a lead-out pipe 15 and is fed to an objective device 16 through a solid separator, a gas refiner and the like (not shown).

The exhaust gas 7 separated from the circulating particles 8 in the separator 9 is guided by an exhaust gas pipe 19 to an induced draft fan 20 and is discharged through a stack 21.

With the circulating fluidized bed furnace 3 being shutdown, the fluidized bed gasification furnace 2 is generally filled with air. Thus, when the circulating fluidized bed furnace 3 is to be started up in this state, there is a fear that the combustive produced gas 14 in the gasification furnace 2 may be mixed with the air to bring about fast and furious combustion. In order to overcome this, an interior of the gasification furnace 2 requires to be purged with inert gas before the startup of the circulating fluidized bed furnace 3.

When the circulating fluidized bed furnace 3 in operation is to be shut down, there is also a fear that admixture of air into the gasification facility filled with combustive produced gas may bring about fast and furious combustion. Thus, the interior of the gasification furnace 2 requires to be purged with inert gas also for shutdown of the gasification facility.

Conventionally, the fluidized bed gasification furnace 2 of the circulating fluidized bed furnace 3 as shown in FIG. 1 is purged such that the gasification furnace 2 is supplied, from below, with inert gas 23 such as nitrogen ($N_2$) or argon (Ar) from an inert gas supply source 22.

In such purging of the gasification furnace 2, not only a produced gas produced from the raw material charged into the fluidized bed 13 of fluidized bed material in the gasification furnace 2 but also the produced gas at and downstream of the freeboard section F must be purged, so that inert gas 23 ($N_2$) is generally required in an amount about five times as much as a capacity of the fluidized bed gasification furnace 2. Such requirement of inert gas 23 in large quantity brings about a problem that a large-sized inert gas producer is required, resulting in substantial increase in cost for purging.

Patent Literature 2 discloses an operating method for a partial gasification and decomposition apparatus wherein gas in the apparatus is purged with steam upon startup and shutdown of the apparatus.

[Patent Literature 1] JP 2005-04195A

[Patent Literature 2] JP 388171B

SUMMARY OF INVENTION

Technical Problems

However, the purging method using steam shown in Patent Literature 2 is not applicable to the fluidized bed gasification furnace 2 of the circulating fluidized bed furnace 3 shown in FIG. 1 for the following reasons. That is, upon shutdown of the fluidized bed gasification furnace 2 where the raw material 10 and residual heat remain, the supply of steam to the furnace 2 for purging brings about a problem that the raw material continues to be gasified and the produced gas is kept produced, resulting in incompletion of the purging even with lapse of long time. Admixture of air in this state may bring about fast and furious combustion.

The invention was made in view of the above and has its object to provide a method and a device for purging a gas production furnace capable of safely and inexpensively purging the gas production furnace within a short time.

Solution to Problems

The invention is directed to a method for purging a gas production furnace comprising a fluidized bed formed and a freeboard section above a bed material so as to produce a produced gas by a reaction of raw material with a gasifying agent and take out the produced gas through the freeboard section, characterized in that, upon shutdown of the gas production furnace, the gas production furnace is supplied with inert gas from below for purging of a gas in the bed material with the inert gas, the freeboard section above the bed material being supplied with steam for purging of a gas in the freeboard section with the steam.

In the method for purging the gas production furnace, it is preferable that the gas in the freeboard section is purged with the steam while at the same time the gas in the bed material is purged with the inert gas.

In the method for purging the gas production furnace, it is preferable that steam obtained in heat exchange with the produced gas taken out from the gas production furnace is used as the steam for purging the freeboard section upon shutdown of the gas production furnace.

In the method for purging the gas production furnace, the gas production furnace being a circulating fluidized bed furnace comprising a combustion furnace and a fluidized bed gasification furnace, it is preferable that, as the steam for purging the freeboard section upon shutdown of the gas production furnace, at least either steam obtained in heat exchange with a produced gas discharged from said fluidized bed gasification furnace or steam obtained in heat exchange with an exhaust gas downstream of the combustion furnace is used.

The invention is directed to a device for purging a gas production furnace comprising a fluidized bed formed and a freeboard section above a bed material so as to produce a produced gas by a reaction of raw material with a gasifying agent and take out the produced gas through the freeboard section, characterized in that the device comprises inert gas supply means for supplying an inert gas to the bed material from below for purging of the bed material with the inert gas, and steam supply means for supplying a steam to a freeboard section above the bed material for purging of a gas in the freeboard section.

In the device for purging the gas production furnace, the gas production furnace being a circulating fluidized bed furnace comprising a combustion furnace and a fluidized bed gasification furnace, it is preferable that the steam supply means has at least either a first heat exchanger for obtaining steam in heat exchange with a produced gas discharged from the fluidized bed gasification furnace or a second heat exchanger for obtaining steam in heat exchange with an exhaust gas downstream of the combustion furnace.

Advantageous Effects of Invention

According to a method and a device for purging a gas production furnace of the invention, upon shutdown or startup of the gas production furnace, the gas production furnace is supplied with an inert gas from below for purging of a produced gas in the bed material with the inert gas while at the same time a freeboard section above the bed material is supplied with steam for purging of a produced gas in the freeboard section; thus, the inert gas supplied will suffice in an amount of purging only the bed material, resulting in substantial reduction in the used amount of the inert gas; the freeboard section may be purged with inexpensive steam, resulting in substantial reduction in cost for purging and in purging time.

When the freeboard section is supplied with steam for purging while at the same time the bed material is purged with the inert gas, the steam for the freeboard section can be prevented from contacting the raw material of the bed material; as a result, a problem that the raw material of the bed material is gasified to newly produce a produced gas can be prevented.

Steam with lower temperature and with lower pressure will suffice as steam for purging the freeboard section, so that residual heat steam produced by residual heat upon shutdown of the gas production furnace may be used for purging of the freeboard section.

REFERENCE SIGNS LIST

Figure 1:
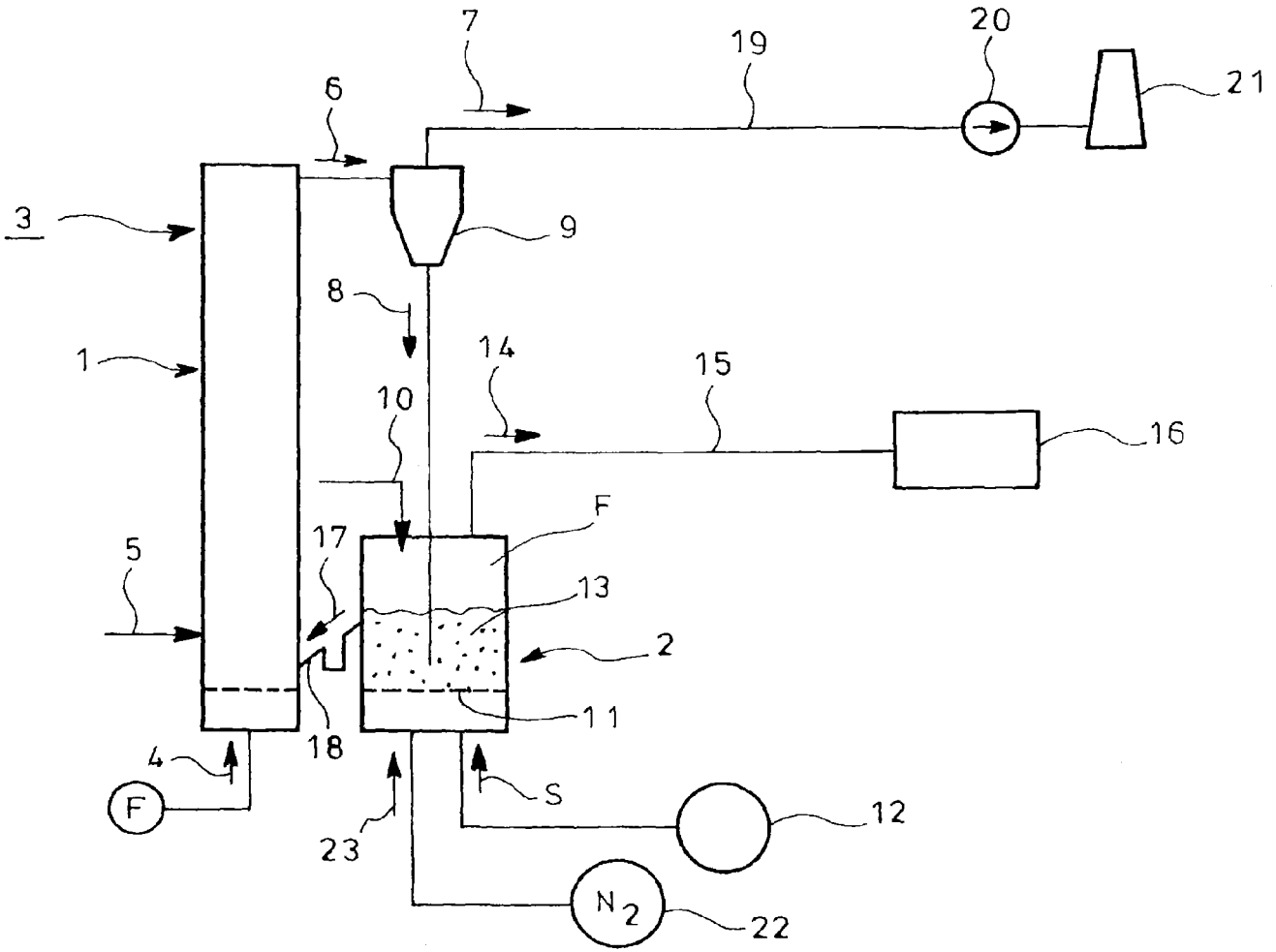
FIG. 1 Prior Art
FIG. 1 is a block diagram for showing an example of a method for purging a circulating fluidized bed furnace as conventional gas production furnace.

1 combustion furnace
2 fluidized bed gasification furnace (gas production furnace)
3 circulating fluidized bed furnace
7 exhaust gas
10 raw material
13 fluidized bed (bed)
14 produced gas
23 inert gas
25 first heat exchanger (steam supply means)
26 second heat exchanger (steam supply means)
31 inert gas supply means
F freeboard section
S' steam
T steam supply means

DESCRIPTION OF EMBODIMENT

An embodiment of the invention will be described in conjunction with the attached drawings.

The invention is disclosed in terms of an example of a method for purging a gas production furnace comprising a fluidized bed formed and a freeboard section above a bed material so as to produce a produced gas by a reaction of raw material with a gasifying agent and take out the produced gas through the freeboard section. This purging method is therefore applicable to a wide variety of gas production furnaces, e.g., any gasification furnaces with a bed material such as a fluidized bed gasification furnace other than the circulating fluidized bed furnace 3 shown in FIG. 1 or a moving or fixed bed gasification furnace, or a coke oven for production of a produced gas through a fixed bed.

Figure 2:
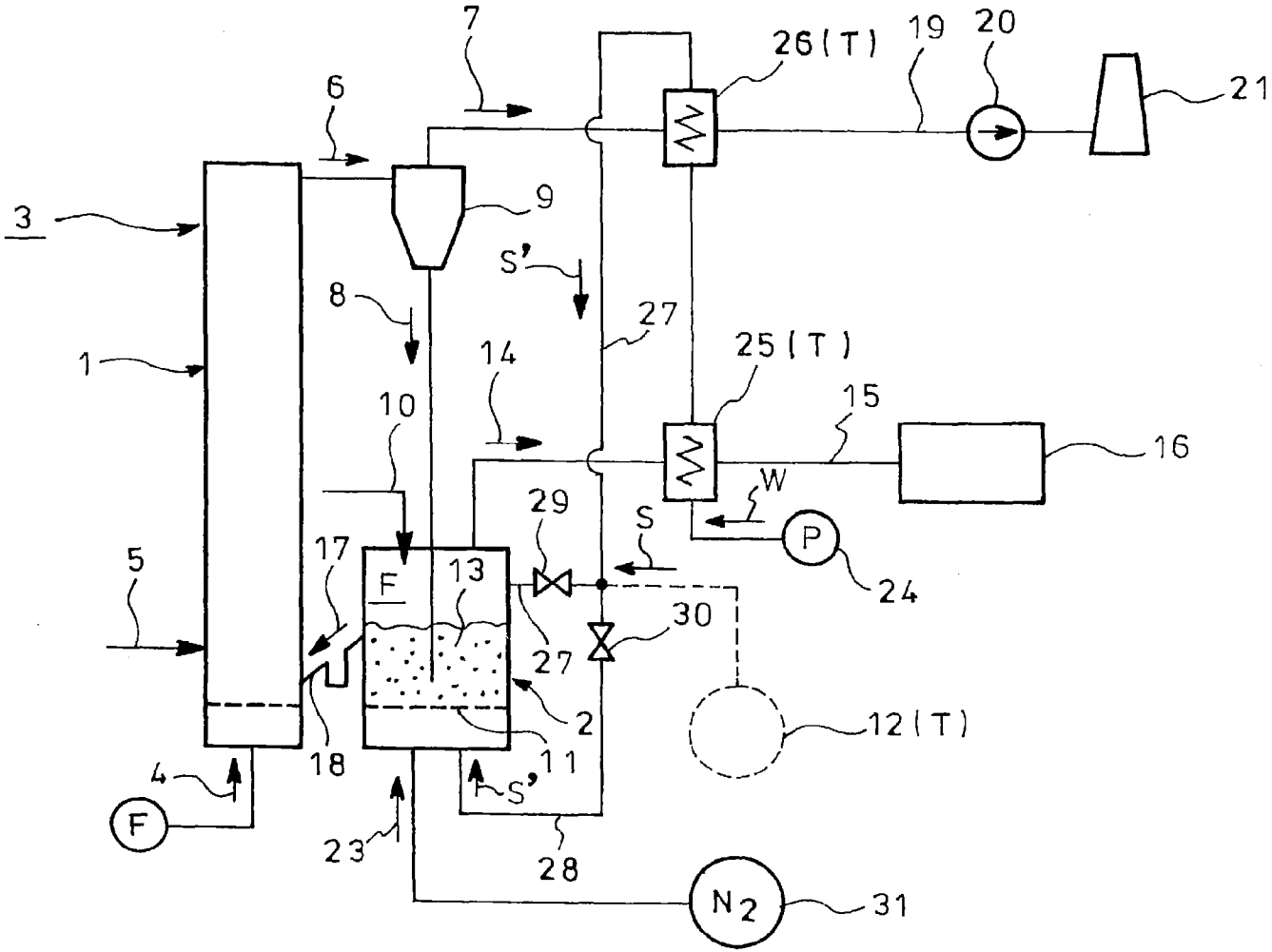
FIG. 2 shows an embodiment of the invention and is a block diagram for a circulating fluidized bed furnace as gas production furnace.

FIG. 2 shows an embodiment of the invention applied to a circulating fluidized bed furnace 3 having a combustion furnace 1 and a fluidized bed gasification furnace 2 (gas production furnace) just like FIG. 1. In FIG. 2, parts similar to those in FIG. 1 are represented by the same reference numerals and the description will be made only with respect to characteristic features of the invention.

As shown in FIG. 2, the fluidized bed gasification furnace 2 (gas production furnace) is provided with steam supply means T for purging a freeboard section F above the bed material. The steam supply means T comprises a first heat exchanger 25 which is disposed in a lead-out pipe 15 for taking out a produced gas 14 and which conducts heat exchange of the produced gas 14 with water W from a pump 24 to produce steam S', and a second heat exchanger 26 which is disposed in an exhaust gas pipe 19 for taking out an exhaust gas 7 from a separator 9 and which conducts heat exchange of the exhaust gas 7 with the steam S' from the first heat exchanger 25 to heat the steam S'. The steam S' discharged from the second heat exchanger 26 is supplied via a steam pipe 27 to the freeboard section F in the fluidized bed gasification furnace 2 to purge the freeboard section F with the steam S'. Exemplified in FIG. 2 is a case where the steam S' from the first heat exchanger 25 is heated by the second heat exchanger 26 and is supplied to the freeboard section F. Alternatively, the steam S' separately produced in each of the first and second heat exchangers 25 and 26 may be supplied to the freeboard section F.

Meanwhile, the steam pipe 27 through which the steam S' from the second heat exchanger 26 is supplied to the freeboard section F is provided with a lower steam pipe 28 which is adapted to supply the steam as the gasifying agent to a portion of the fluidized bed gasification furnace 2 below the diffuser 11 upon the normal operation of the circulating fluidized bed furnace 3. Thus, in this case, the steam supply means T serves also as a gasifying agent supplying device. In FIG. 2, the reference numerals 29 and 30 denote switching means for changeover between the supply of steam S' to the freeboard section F and that to the portion of the fluidized bed gasification furnace 2 below the diffuser 11. Just like FIG. 1, the steam supply means T may be provided with an auxiliary steam device 12 adapted to supply steam S from an auxiliary boiler or other facility when the supplied amount of steam S from the first and second heat exchangers 25 and 26 is insufficient for purging of the freeboard section F upon shutdown of the circulating fluidized bed furnace 3.

The portion of the fluidized bed gasification furnace 2 below the diffuser 11 is provided with inert gas supply means 31 which is adapted to supply the inert gas 23 ($N_2$) in an amount capable of substituting the gas in the bed material of the fluidized bed gasification furnace 2 to purge the bed material in the fluidized bed gasification furnace 2 with the inert gas 23.

Mode of operation of the embodiment shown in FIG. 2 will be described.

For shutdown of the circulating fluidized bed furnace 3 shown in FIG. 2, firstly the supply of the raw material 10 to the fluidized bed gasification furnace 2 is stopped while the switching means 29 and 30 are switched to stop the supply of steam S' to the lower portion of the fluidized bed gasification furnace 2 by the lower steam pipe 28. Then, the inert gas supply means 31 is activated to supply the inert gas 23 ($N_2$) to the portion of the fluidized bed gasification furnace 2 below the diffuser 11 to purge the gas of the fluidized bed 13 (bed) with the inert gas 23 while the switching means 29 and 30 are switched to supply the steam S' from the second heat exchanger 26 to the freeboard section F of the fluidized bed gasification furnace 2 using the steam pipe 27, whereby the freeboard section F is purged with the steam S'. In this case, the charged amount of the inert gas 23 is adjusted such that concurrently ended are purging of the freeboard section F with the steam S' and purging of the bed material in the fluidized bed gasification furnace 2 with the inert gas 23.

In this respect, as mentioned in the above, the bed material in the fluidized bed gasification furnace 2 is purged with and thus covered with the inert gas 23, so that the steam S' supplied to the freeboard section F does not contact any remaining raw material in the fluidized bed 13. As a result, a produced gas is not newly produced by contact of the steam S' with the raw material.

After the circulating fluidized bed furnace 3 is shut down, the supply of the steam S' from the first and second heat exchangers 25 and 26 of the steam supply means T reduces; however, in comparison with the purge of the fluidized bed 13, the freeboard section F may be easily purged even with steam having lower temperature and lower pressure. Thus, upon shutdown of the circulating fluidized bed furnace 3, the steam S' produced by the first and second heat exchangers 25 and 26 is used in utilization of residual heat of the exhaust gas 7 from the combustion furnace 1 and of the produced gas 14 from the fluidized bed gasification furnace 2, so that the freeboard section F of the purging fluidized bed gasification furnace 2 can be effectively purged. If the steam S' required for purging of the freeboard section F is lack upon shutdown of the circulating fluidized bed furnace 3, the auxiliary steam device 12 as steam supply means T may be activated to auxiliary supply the steam S required.

As mentioned in the above, the inert gas 23 supplied to the fluidized bed gasification furnace 2 will suffice in an amount of purging the bed material in the fluidized bed gasification furnace 2, resulting in substantial reduction in the used amount of the inert gas 23. The freeboard section F can be purged with inexpensive steam S', resulting in substantial reduction in cost for purging. Moreover, the fluidized bed 13 and the freeboard section F are separately purged, resulting in substantial reduction in the purging time.

It is to be understood that the invention is not limited to the above embodiment and that various changes and modifications may be made without departing from the scope of the invention. For example, the invention may be applied to various gas production furnaces, e.g., any gasification furnaces with a bed being formed at least upon shutdown such as a fluidized bed gasification furnace or a moving or fixed bed gasification furnace, or a coke oven for production of a produced gas through a fixed bed.

INDUSTRIAL APPLICABILITY

A method and a device for purging a gas production furnace according to the invention can be applied for safe and inexpensive purging of a gas production furnace within a short time upon shutdown of the gas production furnace.

The invention claimed is:

1. A method for purging a gas production furnace, the furnace comprising a fluidized bed and a freeboard section above a bed material arranged so as to produce a produced gas by a reaction of raw material with a gasifying agent in the fluidized bed and take out the produced gas through the freeboard section, the method comprising, upon shutdown of the gas production furnace, supplying the gas production furnace with inert gas from below for purging gas in the bed material with the inert gas, and supplying the freeboard section above the bed material with steam for purging gas in the freeboard section with the steam.

2. The method of claim 1, wherein the gas in the freeboard section is purged with the steam at the same time as the gas in the bed material is purged with the inert gas.

3. The method of claim 2, wherein steam obtained in heat exchange with the produced gas taken out from the gas production furnace is the steam for purging the freeboard section upon shutdown of the gas production furnace.

4. The method of claim 2, wherein the steam for purging the freeboard section upon shutdown of the gas production furnace is at least one of steam obtained in heat exchange with a produced gas discharged from said fluidized bed gasification furnace, or steam obtained in heat exchange with an exhaust gas downstream of the combustion furnace.

5. The method of claim 1, wherein steam obtained in heat exchange with the produced gas taken out from the gas production furnace is the steam for purging the freeboard section upon shutdown of the gas production furnace.

6. The method of claim 1, wherein the steam for purging the freeboard section upon shutdown of the gas production furnace is at least one selected from the group consisting of steam obtained in heat exchange with a produced gas discharged from said fluidized bed gasification furnace, and steam obtained in heat exchange with an exhaust gas downstream of the combustion furnace.

7. A device for purging a gas production furnace, comprising:

a fluidized bed and a freeboard section above a bed material arranged so as to produce a produced gas by a reaction of raw material with a gasifying agent in the fluidized bed and take out the produced gas through the freeboard section;

an inert gas supply unit arranged to supply an inert gas to the bed material from below for purging of the bed material with the inert gas; and a steam supply unit arranged to supply steam to the freeboard section above the bed material for purging of a gas in the freeboard section.

8. The device of claim 7, wherein:

the gas production furnace is a circulating fluidized bed furnace comprising a combustion furnace and a fluidized bed gasification furnace;

the steam supply unit has at least one selected from the group consisting of a first heat exchanger arranged to obtain steam in heat exchange with a produced gas discharged from the fluidized bed gasification furnace and a second heat exchanger arranged to obtain steam in heat exchange with an exhaust gas downstream of the combustion furnace.

* * * * *